US007663353B2

(12) United States Patent
Draxelmayr

(10) Patent No.: US 7,663,353 B2
(45) Date of Patent: Feb. 16, 2010

(54) CIRCUIT ARRANGEMENT FOR VOLTAGE REGULATION

(75) Inventor: Dieter Draxelmayr, Villach (AT)

(73) Assignee: Infineon Technologies AG, Munich (DE)

( * ) Notice: Subject to any disclaimer, the term of this patent is extended or adjusted under 35 U.S.C. 154(b) by 148 days.

(21) Appl. No.: 11/586,417

(22) Filed: Oct. 25, 2006

(65) Prior Publication Data

US 2007/0103129 A1 May 10, 2007

(30) Foreign Application Priority Data

Oct. 25, 2005 (DE) ..... 10 2005 051 084

(51) Int. Cl.
*G05F 1/44* (2006.01)

(52) U.S. Cl. ..... 323/273; 323/282

(58) Field of Classification Search ..... 327/77, 327/91–94, 536–540, 307; 323/282–288
See application file for complete search history.

(56) References Cited

U.S. PATENT DOCUMENTS 5,563,501 A * 10/1996 Chan ..... 323/282
5,675,241 A 10/1997 Teggatz et al.
6,188,212 B1 2/2001 Larson et al.
6,249,112 B1 * 6/2001 Khouri et al. ..... 323/282
7,071,667 B2 * 7/2006 Itohara ..... 323/284
2006/0192681 A1 8/2006 Haider et al.

FOREIGN PATENT DOCUMENTS

DE 103 27 285 A1 1/2005
EP 0 846 996 B1 12/1996

* cited by examiner

*Primary Examiner*—Rajnikant B Patel
(74) *Attorney, Agent, or Firm*—Maginot, Moore & Beck

(57) ABSTRACT

A circuit arrangement for voltage regulation comprises an output, a controllable output transistor connected to the output, an error detection circuit, and a monitoring control circuit. A voltage-regulated output potential can be tapped off the output, the controllable output transistor is connected to the output on a load side and the output transistor comprises a control terminal. The error detection circuit provides a regulating signal if a deviation between the output potential or a potential derived from the output potential and a desired value occurs. By means of the regulating signal the control terminal can be charged or discharged dependent on the deviation and the monitoring control circuit monitors the regulating signal and performs, if the regulating signal lies outside a predetermined range, an additional charging or discharging of the control terminal until the regulating signal lies within the predetermined range.

12 Claims, 4 Drawing Sheets

CIRCUIT ARRANGEMENT FOR VOLTAGE REGULATION

BACKGROUND OF THE INVENTION

The invention relates to a circuit arrangement for voltage regulation.

For the operation of electrical and microelectronic circuits, DC voltages are required which have a voltage value that is complied with over the entire range of the power supply voltage fluctuations, load current fluctuations and temperature fluctuations that occur. For these reasons, a supply voltage is typically not directly suitable as operating voltage, but rather has to be stabilized and smoothed by means of a voltage regulator connected downstream that is provided specifically for this purpose.

Voltage regulators are available—according to the various applications—in a multiplicity of different embodiments and variants. With increasing integration of microelectronic circuits and also with the trend toward operating these microelectronic circuits with an ever lower voltage supply, there is increasingly a demand for voltage regulators having a very low voltage drop. Such voltage regulators are referred to in the relevant literature as so-called "low-drop" voltage regulators. Low-drop voltage regulators work correctly even when the voltage drop between the supply voltage and the regulated output voltage is less than 1 V and, in particular, corresponds to a fraction of a volt. The present invention and also the problem area on which it is based are described below with regard to low-drop voltage regulators, although without restricting the invention thereto.

An essential task of such low-drop voltage regulators is to provide a stabilized supply voltage for an electronic circuit or a corresponding load. In this connection it is desirable for the low-drop voltage regulator to have the best possible regulation characteristic, so that the stabilized output voltage that is regulated by said regulator and provided at the output is therefore as constant as possible. Furthermore, the low-drop voltage regulator should be able still reliably to regulate extremely low voltage drops. A further requirement is for the low-drop voltage regulator to provide a largest possible voltage range for the input voltage on the input side and for it to be able, in particular, to regulate both high and low input voltages. It is furthermore essential for the low-drop voltage regulator to have a minimum power consumption during operation and, moreover, a minimum power loss.

FIG. 1 of the drawing shows a circuit arrangement of a conventional low-drop voltage regulator, which in this case has a PMOS transistor 1 as output transistor. The PMOS 1 is arranged with its controlled path between a supply terminal 2 having a supply potential VDD and an output 3, at which a regulated output potential VOUT is present. The output potential VOUT is fed via a feedback path 8 to an amplifier 4, which compares the output potential VOUT with a reference potential VREF and generates, depending on this comparison, on the output side, a control potential for driving the PMOS transistor 1. What is problematic with this type of voltage regulation is the low stability of the regulating loop and a comparatively long response time, which can essentially be attributed to the use of the PMOS transistor 1.

It would be desirable, therefore, to use an NMOS transistor as output transistor since this component already has a very good regulation characteristic on account of its intrinsic properties. FIG. 2 shows a low-drop voltage regulator which has an NMOS transistor 5 connected in source follower connection as output transistor, that is to say which acts to a first approximation as a constant voltage source. In this case, the control terminal of the NMOS transistor 5 must be able to be charged to a voltage that is higher than the supply potential VDD. This can be realized in a simple manner by means of a charge pump 6, which charges the control terminal of the NMOS transistor 5. A discharging transistor 7 is furthermore provided, which, as necessary, discharges the control terminal of the NMOS transistor 5 again and thus switches off the NMOS transistor 5. The discharging transistor 7 can be driven by means of a signal derived from the output potential VOUT or a suitably chosen control signal. Such a low-drop voltage regulator is described in a similar form for example in U.S. Pat. No. 5,675,241.

What is problematic about this type of a low-drop voltage regulator is the power consumption thereof. The energy efficiency of such a circuit arrangement is relatively poor, since, with this type of voltage regulation, the charge pump 6 supplies the NMOS transistor 7 with a permanent charging current, which is then reduced again by the discharging transistor 7. If the NMOS transistor 7 is not supplied with a permanent charging current, then although a more favorable energy efficiency results, this is at the expense of a significantly poorer regulation characteristic.

FIG. 3 shows a further low-drop voltage regulator such as is described, for example, in European patent No. 0 846 996 B1. The voltage regulator in this case has two regulating stages 10, 11. An essential constituent part of the first regulating stage 10 is a charge pump 6, which supplies the NMOS transistor 5 with a charging current on the output side. The regulation of this first regulating stage 10 is relatively slow, although it enables a high gain on account of the relatively high charging current. Relatively fast disturbances are corrected by means of the second regulating stage 11, which although it provides a very fast regulation, nonetheless has a relatively low gain. A constituent part of the second regulating stage 11 is an inverting amplifier 12, which continuously compares the output potential VOUT, which is divided down by means of a voltage divider 13, with a reference signal VREF and provides a regulating potential VR on the output side depending on the comparison. By means of a capacitor 14, the potential is then matched to the control terminal of the NMOS transistor. At the same time, said regulating potential VR is fed to the charge pump 6 as control signal via an operational amplifier 15.

What is problematic about this solution, however, is that two regulating stages 10, 11 are required for regulating the output potential VOUT, which regulating stages are coupled to one another and thus virtually mutually impede one another in their action. By way of example, either the first regulating loop 10 is dominant, as a result of which the functioning thereof is then impeded by the second regulating loop 11, however. Alternatively, fast voltage changes are intended to be corrected, with the result that the second regulating loop 11 is then dominant. However, said second regulating loop 11 is then impeded in its action by the first regulating loop 10, and vice versa.

For the stability of the entire voltage regulation it is necessary, therefore, to provide a greater or lesser circuit outlay in order that both the slow regulation with high gain and at the same time the fast regulation with low gain are coordinated with one another. This is extremely difficult in many applications, particularly if a highly dynamic, i.e. very fast, correction of very low voltage drops is involved. In reality, this typically leads to a relatively complex circuit arrangement of the voltage regulator, in particular as far as the coordination of the two regulating circuits 11, 12 with one another is concerned. As a result of this additional circuitry outlay, however, this type of a low-drop voltage regulator becomes more or less cost-intensive, which in many applications does not justify the advantage obtained by the two-stage regulation.

In a manner similar to that in the case of the circuit arrangement in FIG. 2, in the case of the circuit arrangement in FIG. 3 as well, the control terminal of the NMOS transistor 5 is charged permanently since the charge pump 6 supplies said control terminal with a permanent charging current. This is not very energy efficient—in a similar manner to that in the case of the exemplary embodiment in FIG. 2.

To compound matters, the charge pump 6 is a regulated charge pump which therefore provides a variable output voltage in a manner dependent on its input voltage. The provision of a regulated charge pump is relatively costly and complex in terms of circuitry and is not especially efficient for energetic reasons.

BRIEF DESCRIPTION OF THE INVENTION

In one aspect of the invention, a circuit arrangement for voltage regulation comprises an output, at which a voltage-regulated output potential can be tapped off, a controllable output transistor connected to the output on the load side, an error detection circuit, which provides a regulating signal in the event of a deviation of the output potential or a potential derived therefrom from a desired value, by means of which regulating signal a control terminal of the output transistor can be charged or discharged in a manner corresponding to the deviation, and a monitoring control circuit, which monitors the regulating signal and which, in the case where the regulating signal lies outside a predetermined voltage range, performs an additional charging or discharging of the control terminal until the regulating signal lies within the predetermined range again.

The idea on which the present invention is based consists, in the case of a low-drop voltage regulator, in dispensing with a two-stage voltage regulation in order to provide the two functionalities of both fast regulation and equally efficient regulation, that is to say regulation furnished with a sufficiently high gain. Rather, the present invention envisages that during operation of the voltage regulator, generally only a single, so-called fine regulation of the voltage is necessary in order to correspondingly activate the control terminal of the output transistor and thereby perform the regulation. In this case, the fine regulation is carried out by an error detection circuit specifically provided for this purpose. The regulation is effected on the basis of the regulated output potential—or a potential derived therefrom by means of a voltage divider for example—in comparison with a desired value. The desired value used may be, by way of example, a suitable reference potential preferably lying within a predetermined voltage range, or a control potential provided by a bandgap monitoring circuit. Said voltage range is designed such that within said predetermined voltage range exclusively the fine regulation is active and undertakes the regulation.

For the case where in contrast a more powerful regulation is required since, by way of example, very high overvoltages or undervoltages are present, it is necessary additionally or alternatively to implement a further possibility of setting the control potential of the output transistor. In this case of an excessively high or excessively low voltage at the output of the error detection circuit, an operating point adjusting device, the method of operation of which is virtually comparable but not identical to a coarse regulation, is connected in, for example by a charge pump or a discharging circuit being supplementarily connected as constituent part of the operating point adjusting device depending on the presence on an undervoltage or overvoltage. This charges or discharges the control terminal of the output transistor until the regulating potential provided by the error detection circuit lies within a predetermined voltage range again. The operating point adjusting device is subsequently deactivated again, so that exclusively the fine regulation by means of the error detection circuit is then active.

Since this case of an excessively high or excessively low voltage occurs relatively infrequently during operation of a voltage regulator, on the one hand the charge pump can remain deactivated for long stretches, which is particularly advantageous for reasons of an improved energy efficiency. On the other hand, it is advantageously possible to use relatively simple pull-up transistors having small dimensions for the charge pump, which consequently provide a relatively low charging current in comparison with previous voltage regulators and conventional charge pumps. This is also sufficient since the case of charging the control potential of the output transistor has to be performed relatively infrequently and usually not to the full amount, which is particularly advantageous in energetic terms. Furthermore, the charge pump as well as the discharging circuit can be realized by very simple circuitry elements and, moreover, given relatively small dimensions.

A further advantage of the inventive voltage regulator is that here there are not two regulating loops which operate antagonistically and the regulations of which operate virtually antagonistically and consequently have to be coordinated with one another in complex fashion, as is the case in some of the known voltage regulators mentioned in the introduction. In the case of the present invention, only a single regulation, namely the fine regulation, is active during normal operation. It is only in a few cases that the operating point adjusting device is additionally or alternatively activated by supplementarily connecting the charge pump or the discharging circuit, which, however, is active only for a short time. This is subsequently deactivated again. A complex coordination of this operating point adjusting device is not necessary. The voltage regulator according to the invention is therefore also distinguished by a very simple topography in terms of circuitry.

What is essential to the invention here is that the charge pump for charging the control terminal of the output transistor only has to be switched on momentarily, only when the charge provided by the level converter is insufficient. In this case, the magnitude of the charging current made available is not significant. This constitutes a significant improvement of a known voltage regulator, as illustrated in EP 846 996 B1 mentioned in the introduction, in which the charge pump is part of a continuously embodied two-stage regulation.

The particular advantage in the case of the inventive voltage regulator also consists in the fact that the error detection circuit and hence the regulating stage of the voltage regulator is able to carry out a voltage regulation even in the event of great deviations (ripple) of the supply voltage, which is otherwise regulated only by means of a sufficiently strong charge pump.

By means of the error detection circuit and also the monitoring control circuit, a regulation mechanism which enables a time-continuous regulation without any interruption to the regulation can be realized in a very simple yet nonetheless highly effective manner.

The output transistor may be formed as an n-channel MOSFET or NMOS transistor for short. Particularly in the case of use in a power electronic circuit, it is advantageous, moreover, to use a power MOSFET as the output transistor.

The output transistor may typically be formed in a source follower connection, in which case, therefore, its drain terminal is connected to a first supply terminal, at which the first supply potential is present, and its source terminal is connected to the output.

One embodiment of the inventive voltage regulator, in terms of circuitry, is very simple and efficient, the error detection circuit is formed as an inverting amplifier in the case of an NMOS output transistor. The output potential or a potential derived therefrom is fed to the amplifier, which may be an operation amplifier for example, on the input side, said amplifier comparing said potential with the desired value or a reference potential. Depending on this comparison, the amplifier provides, on the output side, a correspondingly amplified regulating signal, preferably a regulating potential, which can be used for setting the control potential of the output transistor.

In a further embodiment, a level converter is provided, which is preferably connected downstream of the error detection circuit. The level converter converts the level of the regulating signal or of the regulating potential of the error detection circuit into the control potential, so that the control potential thus obtained is shifted by a specific voltage magnitude with respect to the control potential. In a refinement which, in terms of circuitry, is particularly simple and therefore preferred, the level converter is formed as a capacitive element, in particular as a capacitor.

Another embodiment of the inventive voltage regulator provides a controllable charging and/or discharging circuit as constituent part of an operating point adjusting device, which is/are designed to charge the control terminal of the output transistor with a charging current and/or to discharge it with a discharging current. A controllable charging circuit is preferably formed as a charge pump for providing the charging current. Such a charge pump may be equipped e.g. with simple pull-up transistors. The controllable discharging circuit may likewise preferably have a discharging current source and, in particular, a controllable MOSFET for providing the discharging current.

At least the controllable charging circuit and/or the discharging circuits may be coupled to the monitoring control circuit on the control side. In this case, the monitoring control circuit provides at least one control signal, by means of which the charging and/or discharging circuit can be activated and/or also deactivated again as necessary.

In an alternative embodiment of the inventive voltage regulator, the error detection circuit comprises a bandgap monitoring circuit, which is arranged on the supply side between the output and a second supply terminal and which monitors a bandgap voltage dependent on the output potential. The bandgap monitoring circuit provides the regulating signal on the output side if no bandgap voltage is present. If the bandgap voltage is present, the bandgap monitoring circuit does not generate a regulating signal, with the result that in this case no fine regulation is carried out either. In this case, the control signal is sufficient for the activation of the output transistor and does not have to be readjusted.

In another embodiment of the inventive voltage regulator, a voltage divider, preferably a resistive voltage divider, is provided between the output of the output transistor and an input of the error detection circuit, which voltage divider divides down the output potential in a manner corresponding to its division ratio. In this way, as required the regulated output potential fed to the error detection circuit on the input side can be set in a targeted manner to a value coordinated with the reference potential.

BRIEF DESCRIPTION OF THE SEVERAL VIEWS OF THE DRAWINGS

The present invention is explained in more detail below on the basis of the exemplary embodiments specified in the schematic figures of the drawing, in which.

DETAILED DESCRIPTION OF THE INVENTION

In the figures of the drawings, identical and functionally identical elements, features and signals—unless explained otherwise—are provided with the same reference symbols.

Figure 1:
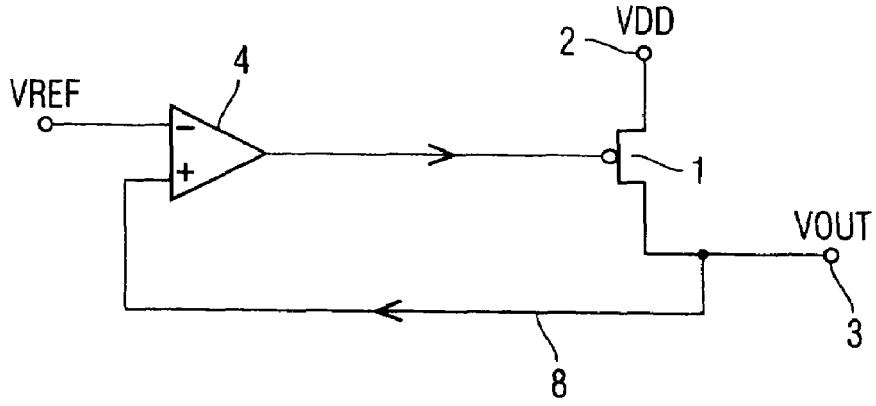
FIG. 1, as discussed above, is a circuit arrangement of a first low-drop switching regulator for elucidating the general problem area.
Figure 2:
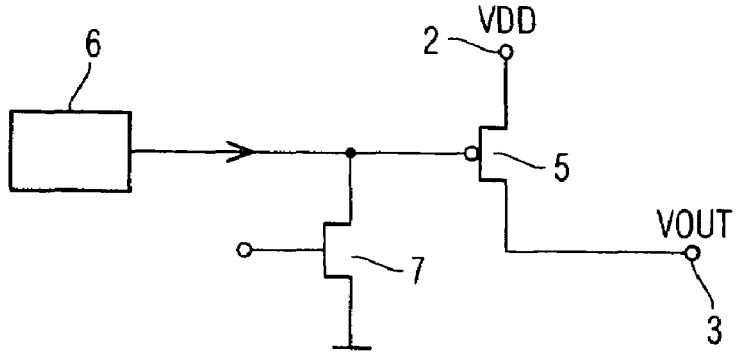
FIG. 2, as discussed above, is a circuit arrangement of a second low-drop voltage regulator for elucidating the general problem area.
Figure 3:
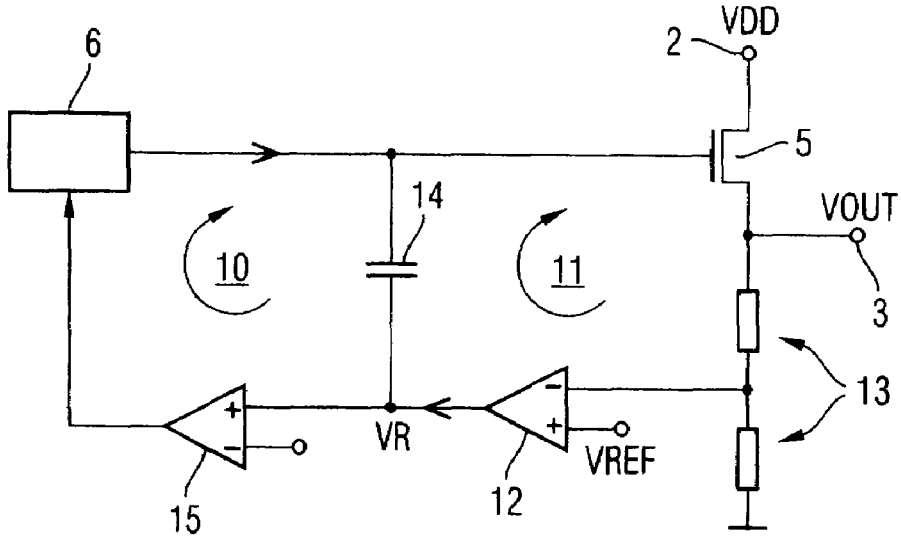
FIG. 3, as discussed above, is a circuit arrangement of a third low-drop voltage regulator disclosed by European patent No. 0 846 996 B1.
Figure 4:
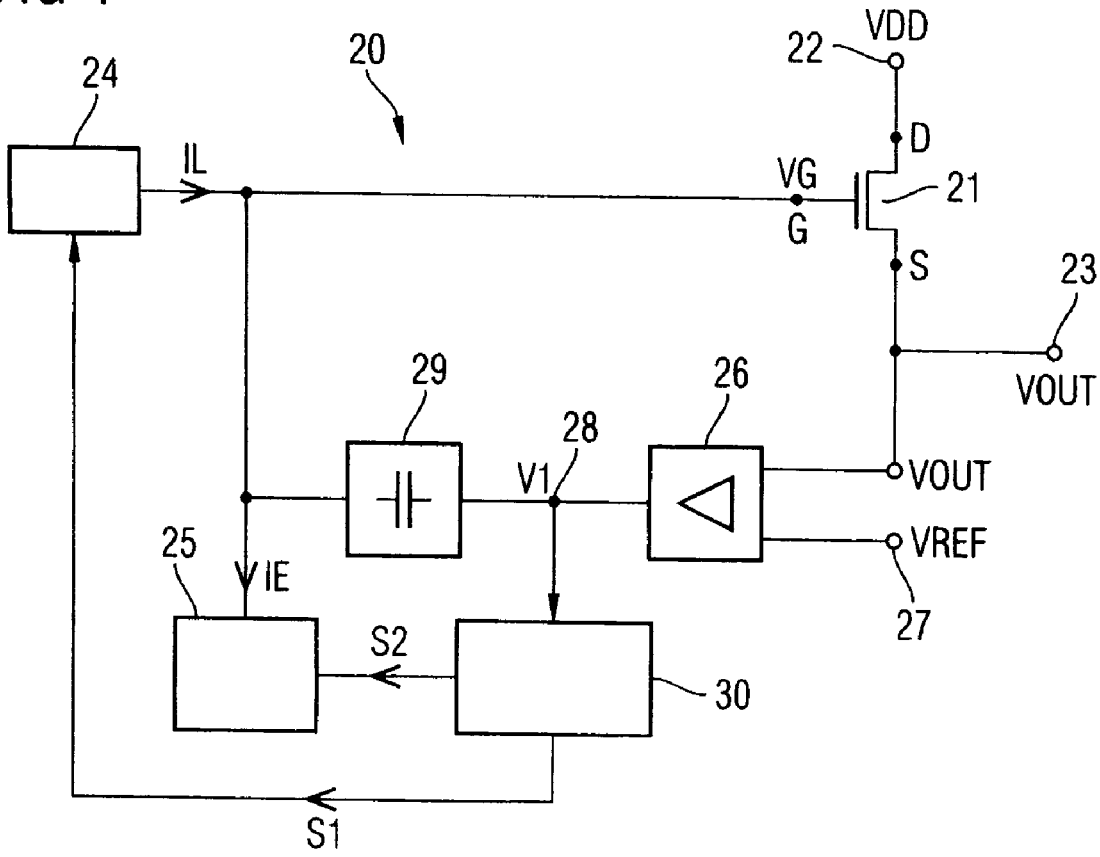
FIG. 4 is a general block diagram of a low-drop voltage regulator according to the invention.

FIG. 4 shows a general block diagram of a low-drop voltage regulator according to the invention, which is designated as voltage regulator 20 hereinafter only for short. The voltage regulator is designated by reference symbol 20 in FIG. 4. The voltage regulator 20 has an output transistor 21, which may be formed as a power transistor for example. According to the invention, said output transistor is formed as an NMOS transistor 21 and forms the regulating transistor for regulating an output potential VOUT. The NMOS transistor 21 is arranged with its controlled path between a first supply terminal 22 and an output terminal 23. A first supply potential, for example a positive supply potential VDD, is present at the first supply terminal 22, whereas a voltage-regulated output signal VOUT derived from the first supply potential VDD can be tapped off at the output terminal 23. The NMOS transistor 21 is thus connected in source follower connection.

The voltage regulator 20 furthermore has a charge pump 24, which is designed to generate, on the output side, a charging current IL for charging a control terminal G to a control potential VG of the NMOS transistor 21. Furthermore, a discharging circuit 25 may be provided, which is likewise connected to the control terminal G and which discharges the control terminal G by means of a discharging current IE as necessary.

According to the invention, the voltage regulator 20 has an error detection circuit 26. On the input side, the error detection circuit 26 is connected to the output terminal 23 and also to a reference input 27, at which a reference potential VREF is present. An output node 28 of the error detection circuit 26 is connected to the control terminal G of the NMOS transistor 21.

A level converter 29 is furthermore arranged between the output node 28 and the control terminal G. The potential V1 present at the output node 28 often lies significantly below the first supply potential VDD, so that the potential V1 does not suffice for charging the control terminal G. In this case, the level converter 29 shifts the potential V1 in a corresponding manner. Said potential is thus suitable for switching on the NMOS transistor 21.

According to the invention, a monitoring circuit 30 is provided in addition to the error detection circuit 26. On the input side, the monitoring circuit 30 is connected to the output node 28 of the error detection circuit 26. On the output side, the monitoring circuit 30 drives the charge pump 24 with a control signal S1 and the discharging circuit with a control signal S2.

The functioning of the voltage regulator 20 according to the invention is explained briefly below.

During operation of a voltage regulator 20, with charge pump 24 activated, the control terminal G can be charged with a charging current IL until the NMOS transistor 21 is correspondingly controlled into the on state. The charge pump 24 can subsequently be turned off. In the ideal case, the potential VG at the control terminal G of the NMOS transistor 21 would then remain constant, whereby the NMOS transistor 21 remains switched on. Without further regulation of the supply potential VDD, an output potential VOUT present at the output terminal 23 would correspond to an unregulated supply potential VDD. In order, then, to provide a voltage-regulated output potential VOUT, the voltage regulator 20 according to the invention has the error detection circuit 26 and the monitoring circuit 30. The error detection circuit 26 compares the output potential VOUT with a reference potential VREF and generates an error potential V1 on the output side depending on this comparison. The error potential V1, which is a measure of the difference between the output potential VOUT and the reference potential VREF, is converted into a control potential VG by a suitably dimensioned level converter 29. Depending on said error potential V1 or the corresponding control potential VG, the NMOS transistor 21 is thus turned on to a greater or lesser extent, so that a very fast and highly effective regulation of the output potential VOUT is possible in this way.

The charge pump 24 thus serves the purpose of presetting the control potential VG at the gate terminal G of the NMOS transistor 21 and hence the operating point thereof approximately to the desired control potential VG, in which case the control potential VG need not necessarily be set exactly here. The fine regulation of the control potential VG is then effected by means of the error detection circuit 26 and the level converter 29 connected downstream. A monitoring control circuit 30 is additionally provided, which monitors the regulating potential V1 with regard to overvoltage or undervoltage. The monitoring control circuit 30 detects whether the regulating potential V1 lies above or below a predetermined voltage threshold SATP, SATL (see FIG. 6). If the regulating potential V1 lies within these thresholds SATP, SATL, then only the error detection circuit 26 undertakes the regulation for setting the control potential VG of the NMOS transistor 21. If, by contrast, the regulating potential V1 lies outside, that is to say above or below, the predetermined voltage thresholds SATP, SATL, then the monitoring circuit 30 correspondingly drives the charge pump 24 or the discharging circuit 25 by means of the control signals S1, S2. In this case, the charge pump 24 or the discharging circuit 25 is usually controlled into the switched-on state in order thereby to perform charging or discharging of the control terminal G to the control potential VG.

As soon as the regulating potential V1 lies within the thresholds SATL, SATP and thus within the active range 33 again, the discharging circuit 25 or the charge point 24 is switched off again and thus deactivated—in contrast to EP 846 996 B1 described in the introduction. The charge pump 24 and the discharging circuit 25 thus function as an operating point adjusting circuit and not as regulating circuits, as is the case in EP 846 996 B1. Consequently, the voltage regulator according to the invention only has a single regulation, also designated as fine regulation above, and also a device 24, 25, 30 for operating point adjustment or for operating point setting.

Figure 5:
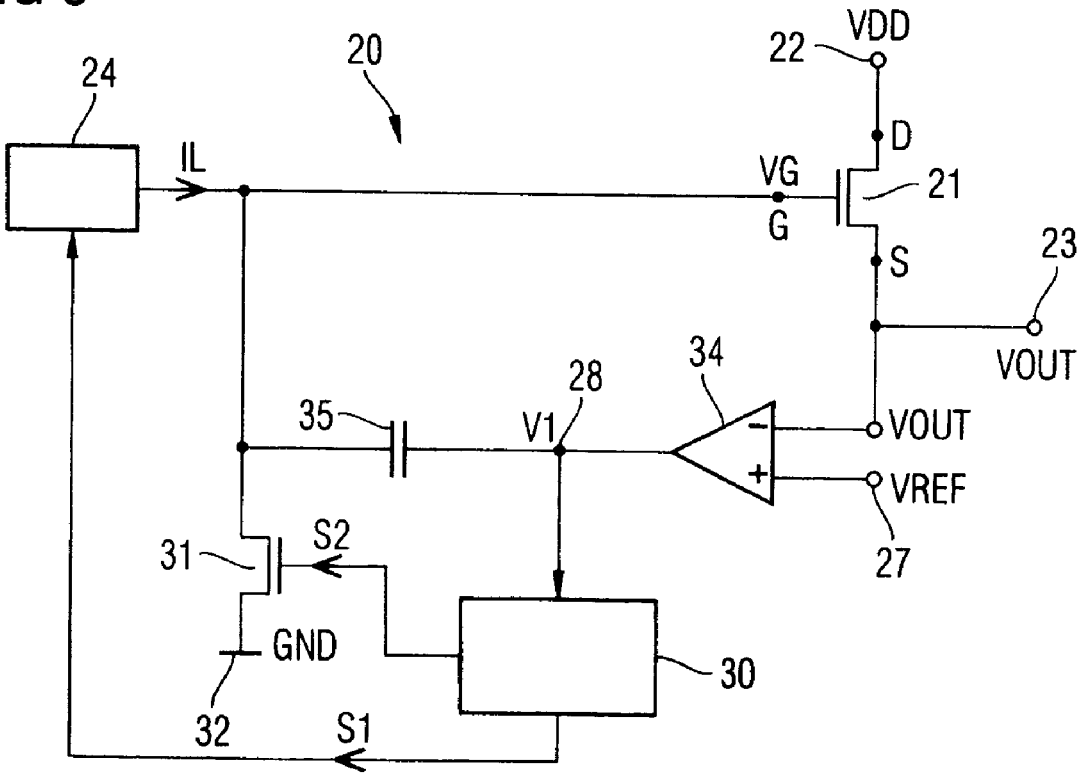
FIG. 5 is a detailed block diagram of a first exemplary embodiment of an inventive low-drop voltage regulator.

FIG. 5 shows a more detailed illustration of the voltage regulator according to the invention by comparison with the general illustration in FIG. 4. Here the error detection circuit 26 has an inverting amplifier 34. Here the level converter is formed as a capacitor 29 and the discharging circuit 25 is formed as an NMOS transistor 31. The controlled path of the NMOS transistor 31 is connected between the control terminal G of the NMOS transistor 21 and a second supply terminal 32, at which a second supply potential GND, for example the potential of the reference ground GND, is present. On the control side, the NMOS transistor 31 is driven with the control signal S2 by means of the monitoring control circuit 30.

During operation, after an initial charging of the control terminal VG, the charge pump 24 and also the discharging circuit 25 are in the switched-off state. This also results in a high energy efficiency of the voltage regulator 20, since the control terminal G of the NMOS transistor 21 is not permanently charged with a charging current IL. During operation, the charge pump 24 merely serves the purpose of charging the control terminal G of the NMOS transistor 21 if the charge stored in the capacitor 35 is no longer sufficient in the course of operation for example on account of leakage currents.

Here the fine regulation is exclusively carried out by means of the error detection circuit 26 and by means of the level converter 29 connected downstream. A time-continuous regulation is provided in this way.

The function of the monitoring control circuit 30 shall be described briefly below with reference to the schematic illustration in FIG. 6. Here the upper and the lower voltage thresholds are designated by SATP and SATL, respectively. The voltage range between the upper and lower thresholds SATP, SATL designates the active voltage range 33 within which the regulating potential V1 should lie. The monitoring control circuit 30 monitors whether the regulating potential V1 is within the active voltage range 33 or gets close to the limits thereof. If the regulating potential V1 at the output terminal 28 exceeds the upper voltage threshold SATP, then the monitoring control circuit 30 activates the charge pump 24 by means of the control signal S1. The charge pump 24 is switched on and supplies the control terminal G with a charging current IL until the regulating potential V1 again lies below SATP and thus within the voltage range 33. The monitoring control circuit 30 activates the discharging circuit 25 in the same way, so that the control terminal G is discharged by means of the discharging current IE if and for as long as the regulating potential V1 lies below the voltage threshold SATL.

Figure 6:
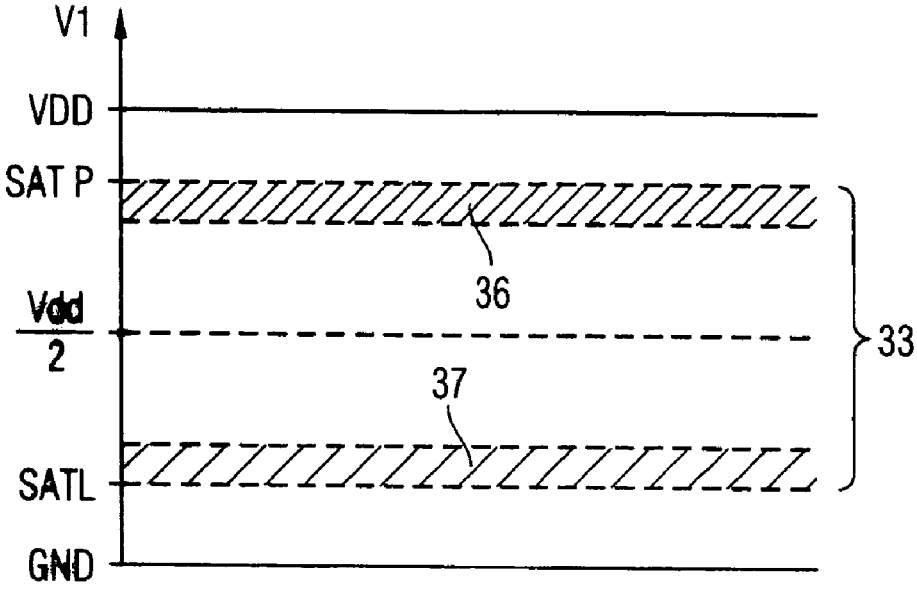
FIG. 6 is a schematic diagram for illustrating the thresholds of the monitoring control circuit.

In FIG. 6, reference symbol 36 designates an upper hysteresis range for the upper voltage threshold SATP and 37 designates a lower hysteresis range for the lower voltage threshold SATL. It is expedient to provide a hysteresis range 36, 37 in order to prevent the corresponding charging or discharging circuit 24, 31 from being continuously switched on and off momentarily when the regulating potential V1 is in the region of one of the two thresholds SATP, SATL.

As will be described below with reference to FIG. 7, the lower hysteresis range 37 can be realized by means of a discharging transistor 31 controlled by means of a bias voltage VBIAS and arranged with its load path in parallel with the level converter, said discharging transistor virtually performing a self-regulation. The upper hysteresis range 36 can be realized by means of a corresponding device or alternatively also by means of a suitable control device (not illustrated in the figures).

Figure 7:
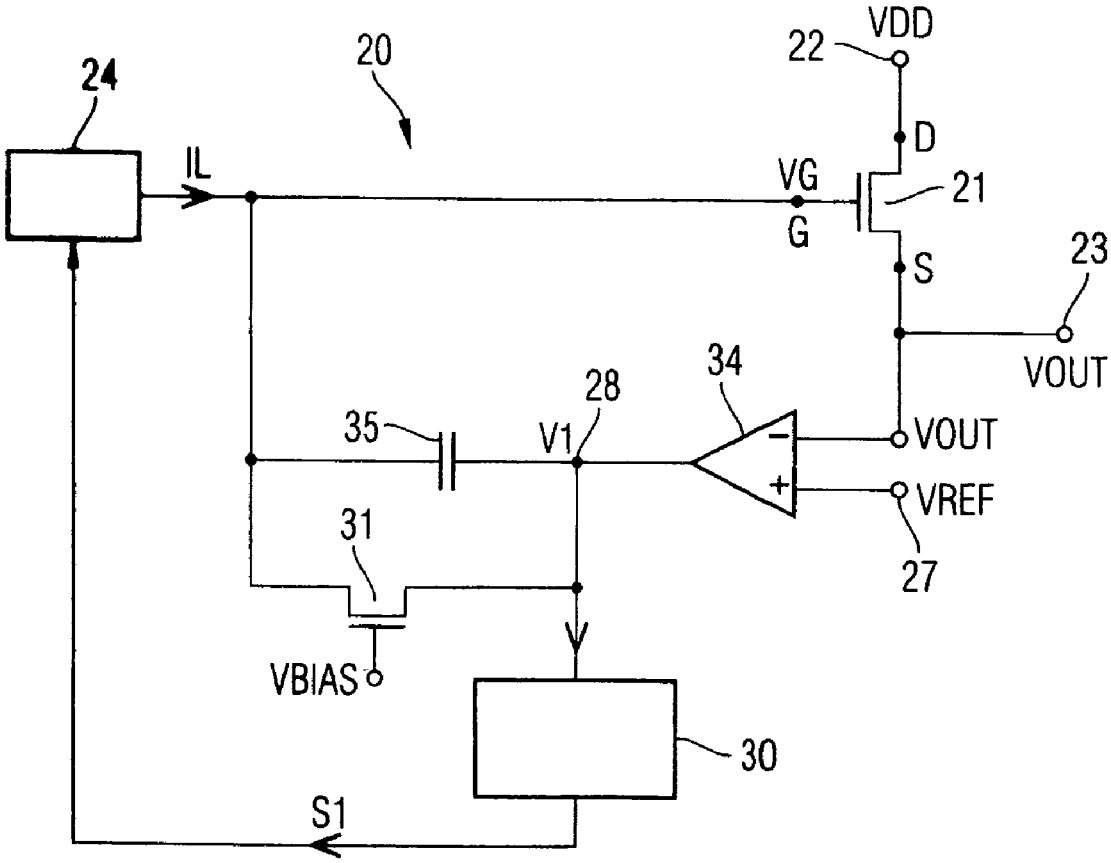
FIG. 7 is a detailed block diagram of a second exemplary embodiment of an inventive low-drop voltage regulator according to the invention.

FIG. 7 shows a second exemplary embodiment of a voltage regulator 20 according to the invention. In contrast to the exemplary embodiment in FIG. 5, here the NMOS transistor 31 of the discharging circuit 25 is arranged with its controlled path in parallel with the capacitor 29 of the level converter. Here, therefore, the NMOS transistor 31 of the discharging circuit 25 is not driven by means of the monitoring control circuit 30, but rather by means of the BIAS voltage VBIAS. Here the NMOS transistor 31 is preferably designed such that the lower voltage threshold SAPL approximately corresponds to the bias voltage VBIAS minus the threshold voltage Vth of the NMOS transistor 31. If the regulating potential V1 becomes too low in this case, then the NMOS transistor 31 is automatically controlled into an on state, as a result of which the control terminal G of the NMOS output transistor 21 is discharged. As a result, the output potential VOUT becomes lower, as a result of which the error detection circuit 26 raises the potential V1 at the output terminal 28 again, which directly leads to the NMOS transistor 31 being switched off again. A dynamic self-regulating regulation mechanism is provided in this way, which discharges the control terminal G of the NMOS transistor 21 precisely to the extent required for the provision of a voltage-stabilized, regulated regulating potential V1.

Preferably, but not necessarily, the charge pump 24 contains so-called pull-up transistors designed in a relatively weak fashion. This means that the charge pump 24 and, consequently, its charge pump current IL can be limited to a relatively low current value for reasons of energy efficiency. This is possible by virtue of the fact that the control terminal G does not have to be supplied with a permanent charging current IL, but rather is charged only once and momentarily and the actual regulation is effected by means of the error detection circuit 26 and also the level converter 29.

Figure 8:
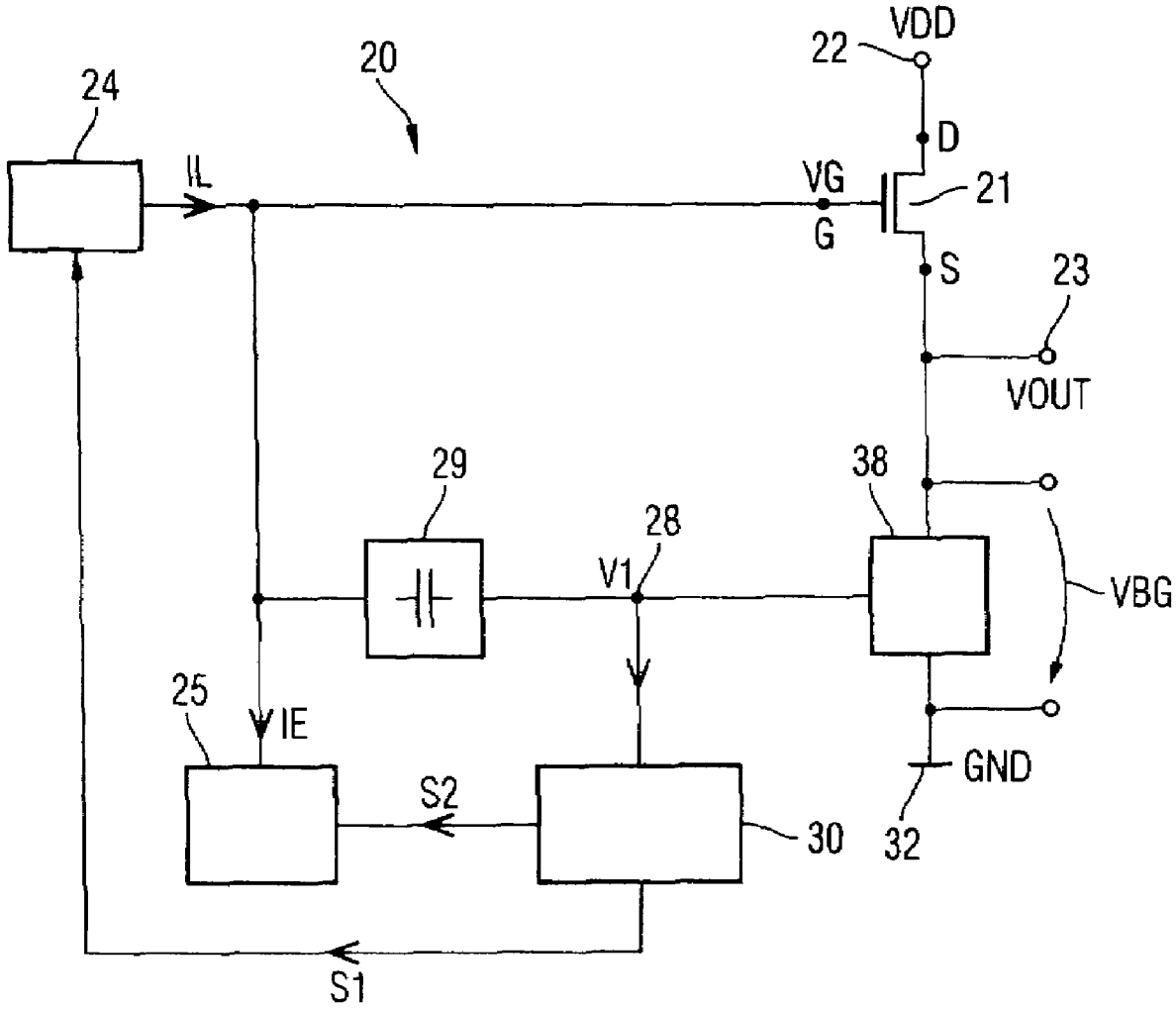
FIG. 8 is a block diagram of a third exemplary embodiment of an inventive low-drop voltage regulator according to the invention.

FIG. 8 shows a third exemplary embodiment of a voltage regulator 20 according to the invention. In contrast to the exemplary embodiment in FIG. 5, here a bandgap monitoring circuit 38 is arranged between the output terminal 23 and the output terminal 28 instead of the error detection circuit 26. A bandgap-based voltage VBG is thus intended to be dropped between the output terminal 23 and a second supply terminal 32, at which the reference-ground potential GND is present. The bandgap monitoring circuit 38 is formed in such a way that it provides a regulating potential V1 at the output 28 in the event of deviation of the output voltage from a desired voltage, analogously to the function of the amplifier 26 in FIG. 4. In particular, the bandgap monitoring circuit 38 then provides a regulating potential V1 if no bandgap-based voltage VBG is present. If a bandgap-based voltage VBG is present, then the bandgap monitoring circuit 38 does not set a regulating potential V1 at the output 28, with the result that no fine regulation of the control potential VG is effected in this case.

It goes without saying that the bandgap monitoring circuit 38 does not have to be restricted to the bandgap principle and was mentioned here only by way of example, and may also be embodied differently, for example by means of zener diodes.

Although the present invention has been described above on the basis of preferred exemplary embodiments, it shall not be restricted thereto, but rather can be modified in diverse ways.

Thus, the discharging circuit need not necessarily be formed by means of an NMOS transistor, but rather could also be realized by arbitrary other discharging means, for example with application of a hysteresis discharge.

In the same way, the monitoring control circuit need not necessarily realize an overvoltage or undervoltage detection on the basis of the output signal of the error detection circuit. In addition or as an alternative, it would also be possible for the error detection circuit to determine this function directly on the basis of the output potential.

The error detection circuit also need not necessarily be restricted to the use of a simple amplifier, although this represents a realization of this function which is highly elegant and simple in terms of circuitry. It should additionally be mentioned that, at the input of the error detection circuit, the output signal can, of course, be divided down by means of correspondingly designed voltage dividers.

As level converter, in addition to a capacitor it is also possible to implement other circuitry means which are suitable for shifting a first voltage level of the regulating potential into a different voltage level with respect thereto, although the use of a simple capacitor represents a highly elegant option particularly in the case of an integrated voltage regulator. In the same, it may also be provided that, in addition or as an alternative, a level converter is provided between the output terminal and an input of the area detection circuit.

Instead of no or two hysteresis ranges, it is also possible, of course, to provide only one upper or one lower hysteresis range.

What is claimed is:

1. A circuit arrangement for voltage regulation, comprising:

an output, at which a voltage-regulated output potential can be tapped off;

a controllable output transistor connected to said output on a load side; said output transistor comprising a control terminal;

an error detection circuit providing a regulating signal if a deviation between said output potential or a potential derived from said output potential and a desired value occurs; by means of said regulating signal said control terminal can be charged or discharged dependent on said deviation, a monitoring control circuit monitoring said regulating signal and performing, if said regulating signal lies outside a predetermined range, an additional charging or discharging of said control terminal until said regulating signal lies within said predetermined range, and an operating point adjusting circuit for adjusting an operating point of the output transistor, the operating point adjusting circuit coupled between the monitoring control circuit and the control terminal of the output transistor and having a controllable charging circuit for generating a charging current for charging said control terminal and a discharging circuit for discharging said control terminal by means of a discharging current.

2. The circuit arrangement of claim 1, wherein said output transistor is an n-channel MOSFET or an n-channel power MOSFET.

3. The circuit arrangement of claim 1, wherein said output transistor is formed in source follower connection comprising a drain terminal and a source terminal; said drain terminal being connected to a first supply terminal, at which said first supply potential is present, and said source terminal being connected to said output.

4. The circuit of claim 1, wherein said error detection circuit comprises an amplifier comparing said output potential or said potential derived from said output potential with said desired value and providing, depending on said comparing, on an output of said amplifier an amplified regulating signal for driving said control terminal.

5. The circuit of claim 4, wherein said amplifier is an inverting amplifier.

6. The circuit arrangement of claim 1, comprising a level converter shifting a level of said regulating signal into a control potential.

7. The circuit arrangement of claim 6, wherein said level converter is formed as a capacitive element or as a capacitor.

8. The circuit arrangement of claim 1, wherein said controllable charging circuit comprises a charge pump or a charge pump equipped with pull-up transistors for providing said charging current.

9. The circuit arrangement of claim 1, wherein said controllable discharging circuit comprises a discharging current source or a controllable MOSFET V for providing said discharging current.

10. The circuit arrangement of claim 1, wherein said controllable charging circuit or said controllable discharging circuit is coupled to said monitoring control circuit; said monitoring control circuit V providing at least one control signal, by means of which said charging or said discharging circuit can be activated or deactivated.

11. The circuit arrangement of claim 1, wherein said error detection circuit comprises a bandgap monitoring circuit arranged, on a supply side, between said output and a second supply terminal, which monitors a bandgap voltage dependent on said output voltage and which generates said regulating signal on the output side if no bandgap voltage is present.

12. The circuit arrangement of claim 1, comprising a voltage divider between said output and an input of said error detection circuit; said voltage divider dividing down said output potential in a manner corresponding to a division ratio of said voltage divider.

* * * * *